US010059505B2

(12) United States Patent
Tanbo et al.

(10) Patent No.: US 10,059,505 B2
(45) Date of Patent: Aug. 28, 2018

(54) PACKAGE OF ROD-SHAPED SMOKING ARTICLES AND A BLANK FOR THE PACKAGE

(75) Inventors: Hitoshi Tanbo, Tokyo (JP); Toru Iwano, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 0 days.

(21) Appl. No.: 12/609,256

(22) Filed: Oct. 30, 2009

(65) Prior Publication Data

US 2010/0044255 A1 Feb. 25, 2010

Related U.S. Application Data

(63) Continuation of application No. PCT/JP2008/057699, filed on Apr. 21, 2008.

(30) Foreign Application Priority Data

May 1, 2007 (JP) ..... 2007-120676

(51) Int. Cl.
*B65D 85/10* (2006.01)
*B65D 5/42* (2006.01)

(52) U.S. Cl.
CPC ..... *B65D 85/1045* (2013.01); *B65D 5/4266* (2013.01); *Y10T 428/24479* (2015.01)

(58) Field of Classification Search
CPC ..... B65D 5/4266; B65D 85/1072; B65D 85/1018
USPC ..... 206/259, 258, 273, 275, 87.13; 229/198.2
See application file for complete search history.

(56) References Cited

U.S. PATENT DOCUMENTS

| | | | | |
|---|---|---|---|---|
| 3,526,566 | A * | 9/1970 | McIlvain, Jr. et al. | 428/121 |
| 4,655,366 | A * | 4/1987 | Sykes | 229/122.33 |
| 5,143,282 | A * | 9/1992 | Pham | 229/160.1 |
| 5,167,606 | A * | 12/1992 | Kuchenbecker | B65D 5/06 493/160 |
| 5,819,924 | A * | 10/1998 | Sigrist et al. | 206/264 |
| 5,924,627 | A * | 7/1999 | Wilder et al. | 229/182.1 |
| 7,007,838 | B1 * | 3/2006 | Bostick, II | 229/192 |
| 7,044,294 | B2 * | 5/2006 | Lutzig | 206/259 |
| D594,322 | S * | 6/2009 | Blick | D9/423 |
| 2003/0047471 | A1 * | 3/2003 | Brizzi | 206/273 |
| 2005/0224375 | A1 | 10/2005 | Focke et al. | |
| 2006/0054518 | A1 | 3/2006 | Focke et al. | |

FOREIGN PATENT DOCUMENTS

| | | | |
|---|---|---|---|
| EP | 0900736 | A2 | 8/1998 |
| EP | 2022729 | A1 | 2/2009 |
| JP | 4-279446 | A | 10/1992 |
| JP | 2004-59001 | A | 2/2004 |

(Continued)

*Primary Examiner* — Anthony Stashick
*Assistant Examiner* — Raven Collins
(74) *Attorney, Agent, or Firm* — Birch, Stewart, Kolasch & Birch, LLP

(57) ABSTRACT

A hinge-lid package has a box body (8) and a lid (6) which are formed from a blank. The box body (8) and the lid (6) have rounded edges (16 and 18) as longitudinal edges thereof. The rounded edge (16 and 18) has an arc-like shape created by a groove pattern formed only in the inner surface of the rounded edge. The groove pattern makes the corresponding lattice design (F) appear in the outer surface of the rounded edge (16 and 18).

16 Claims, 7 Drawing Sheets

(56) References Cited

FOREIGN PATENT DOCUMENTS

| | | | | |
|---|---|---|---|---|
| JP | 2004059001 | | * | 2/2004 |
| JP | 2004-524228 | A | | 8/2004 |
| JP | 2005-523854 | A | | 8/2005 |
| UA | 882920 | C2 | | 10/2009 |
| WO | 02/49940 | A1 | | 6/2002 |
| WO | 02/064452 | A1 | | 8/2002 |
| WO | WO02064452 | | * | 8/2002 |

* cited by examiner

PACKAGE OF ROD-SHAPED SMOKING ARTICLES AND A BLANK FOR THE PACKAGE

This application is a Continuation of co-pending Application No. PCT/JP2008/057699 filed on Apr. 21, 2008, which designated the United States, and on which priority is claimed under 35 U.S.C. § 120. This application also claims priority under 35 U.S.C. § 119(a) on Patent Application No(s). 2007-120676 filed in Japan on May 1, 2007. The entire contents of each of the above documents is hereby incorporated by reference.

TECHNICAL FIELD

The present invention relates to a package of rod-shaped smoking articles, such as cigarettes and filter cigarettes, and a blank for the package.

BACKGROUND ART

A package of this type is generally called a hinge-lid package. The hinge-lid package has a rectangular parallelepiped shape as a whole and includes four angular edges extending along its longitudinal direction. For that reason, a package of this type does not fit well in the hand when the user grasps the package.

To solve this problem, one well-known package has rounded edges instead of angular edges (for example, Patent Document 1). The rounded edge has an arc-like shape as viewed in cross-section of the package. In the case of the package disclosed in Patent Document 1, the arc-like shape of the rounded edge is produced by a notch line array formed in the inner surface of a blank for the package. More concretely, the notch lines extend parallel to each other along the longitudinal direction of the package, or of the blank. Notch line arrays are not exposed in the outer surface of the package, so that they do not disfigure the package, and the package fits well in the hand when the user grasps the package.

Patent Document 1: Published Patent Application No. 2004-524228

DISCLOSURE OF THE INVENTION

Problems to be Solved by the Invention

In the case of the package disclosed in Patent Document 1, although the rounded edges have smooth outer surfaces, the package has a plain and simple form, and therefore do not improve the appearance of the package.

It is an object of the invention to provide a package of rod-shaped smoking articles, which has rounded edges that help improve the package appearance, and a blank for the package.

Means for Solving the Problem

In order to achieve the object, a package of the invention comprises a box body with an open end, the box body including a rounded edge forming at least one longitudinal edge extending along a longitudinal direction of the box body, the rounded edge having an arc-like shape as viewed in cross-section of the box body and a groove pattern only in an inner surface of the rounded edge, wherein the groove pattern provides the arc-like shape of the rounded edge and causes a design in an outer surface of the rounded edge to appear; and a lid connected to the open end of the box body through a hinge, for opening and closing the open end.

The groove pattern gives flexibility to the rounded edge, and thus easily and reliably provides the arc-like shape of the rounded edge. A design corresponding to the groove pattern that is exhibited in the outer surface of the rounded edge adds a unique figure to the package. The size, or curvature radius, of the arc of the rounded edge is determined only by width of the groove pattern.

To be more specific, the groove pattern forms a lattice design having diamond-shaped meshes or slash design.

Preferably, the rounded edge is formed in each of four longitudinal edges of the box body. In this case, the box body may further include reinforcing patches that are disposed in the inner surfaces of the round edges and stretch across the groove patterns in the vicinity of the open end.

The invention also provides a blank for the package. The blank will be described in the explanation of one embodiment below.

Technical Advantage of the Invention

In the package of rod-shaped smoking articles and a blank therefore according to the present invention, since the rounded edge is obtained by the groove pattern formed only in the inner surface of the rounded edge, the groove pattern is not exposed in the outer surface of the rounded edge. The groove pattern makes the design corresponding to the groove pattern appear in the outer surface of the rounded edge. As a result, the package of the invention provides a unique appearance as compared to conventional packages, and is excellent in appearance.

With or without the groove patterns, the reinforcing patches prevent a deformation in the open end of the box body, so that the lid can be smoothly and reliably opened/closed.

BEST MODE FOR CARRYING OUT THE INVENTION

Figure 1:
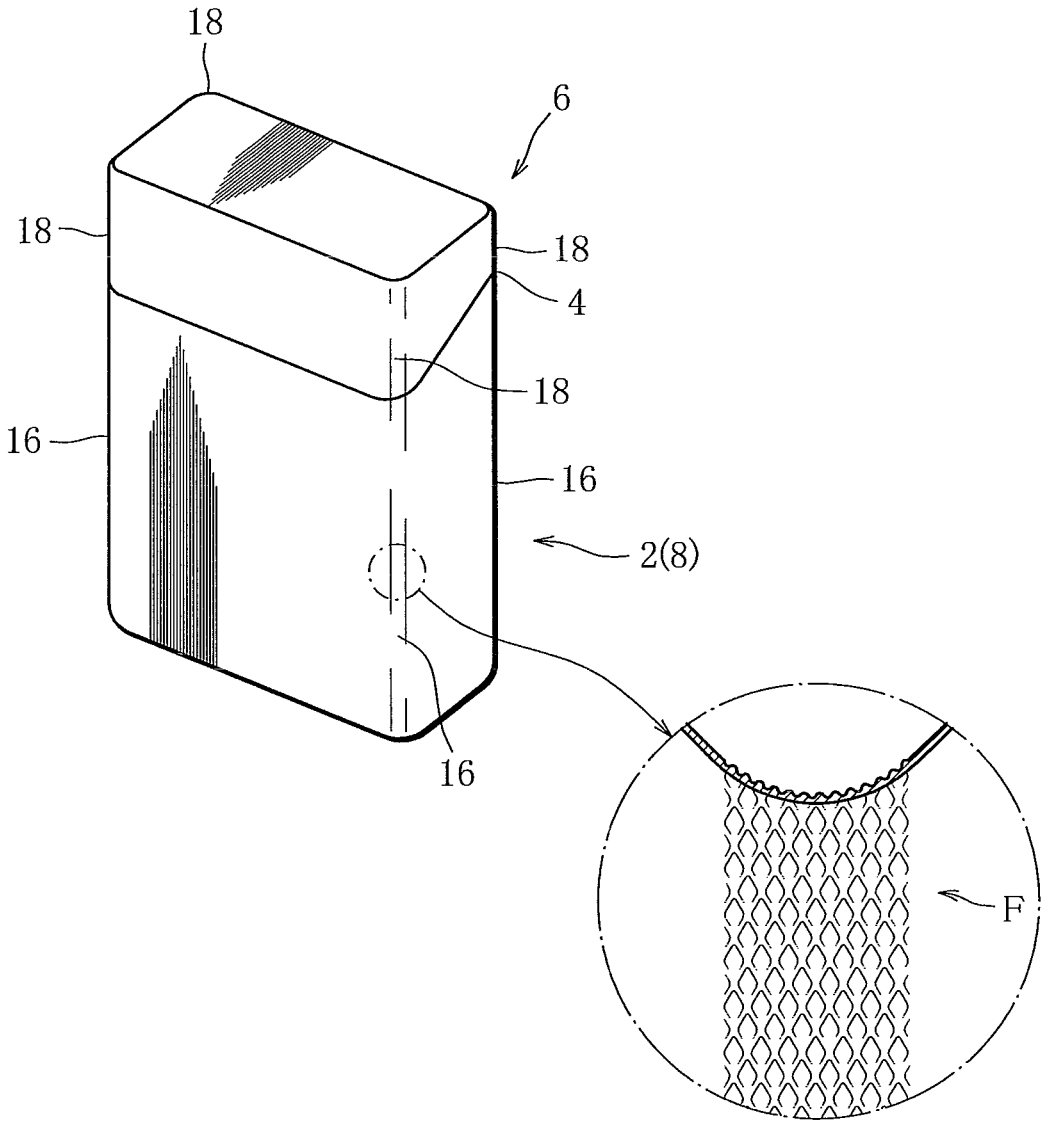
FIG. 1 is a perspective view showing a package of one embodiment in a closed position thereof.

FIG. 1 shows a hinge-lid package of one embodiment.

The package shown in FIG. 1 has a substantially rectangular parallelepiped shape as a whole, and is covered with a transparent overwrapping film (not shown). The overwrapping film has a tear tape. When the overwrapping film is opened along the tear tape, the package is partially exposed. The overwrapping film is omitted from FIG. 1.

The package includes a box 2. The box 2 has an upper end that is open. This open end is closed with a lid 6. The lid 6 is connected to a rear edge of the open end of the box 2 through a self hinge 4. The lid 6 is capable of turning around the self hinge 4, to thereby open/close the open end of the box 2.

Figure 2:
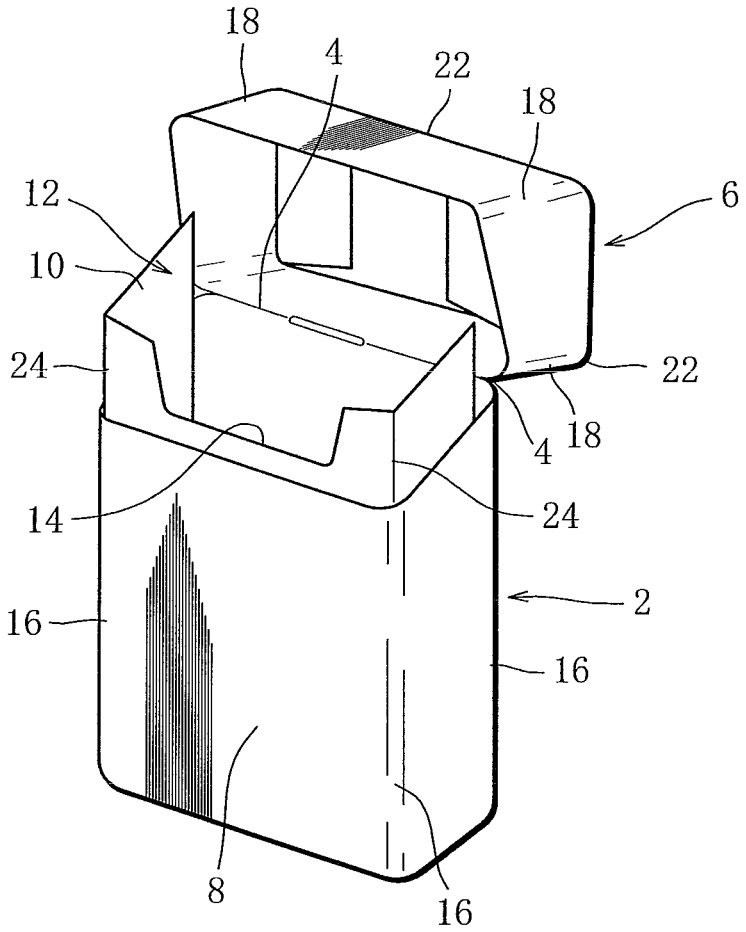
FIG. 2 is a perspective view showing the package shown in FIG. 1 in an open position thereof.

More specifically, as is apparent from FIG. 2, the box 2 includes a box body 8, and the box body 8 has an upper end cut open at an angle. The box 2 further includes an inner frame 10 having a shape of letter U. The inner frame 10 is partially projecting from the upper end of the box body 8 and forms the open end 12 of the box 2. The inner frame 10 has an access opening 14 in a front wall thereof. The access opening 14 has a substantially U-like shape.

The lid 6 has a box-like shape and a lower end cut open at an angle. The lid 6 closes the open end 12 of the box 2 so as to cover a projecting portion of the inner frame 10. At this time, the lower end of the lid 6 meets to the upper end of the box body 8.

The box body 8 of an ordinary type has four angular edges extending in the longitudinal direction thereof. According to the embodiment, however, the box body 8 has rounded edges 16 instead of angular edges. The rounded edges 16 each have an arc-like shape as viewed in cross-section of the box body 8. The lid 6 also has similar rounded edges 18 corresponding to the rounded edges 16. When the lid 6 is closed, each of the rounded edges 16 and the corresponding rounded edge 18 are aligned with each other as is obvious from FIG. 1, thereby forming one longitudinal edge of the package.

The inner frame 10 generally includes two angular edges 24.

Figure 3:
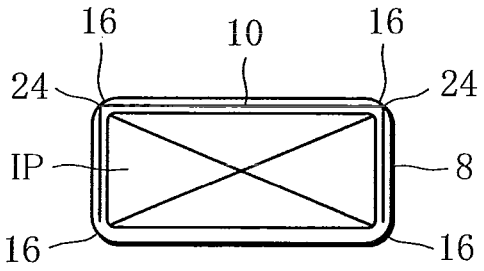
FIG. 3 is a cross-sectional view showing a box body shown in FIGS. 1 and 2.

As is clear from FIG. 3, an inner pack IP is contained in the box body 2. The inner pack IP is surrounded by the inner frame 10. The inner pack IP includes a bundle of twenty filter cigarettes as rod-like smoking articles, and an inner wrapping material in which the bundle is wrapped.

Figure 4:
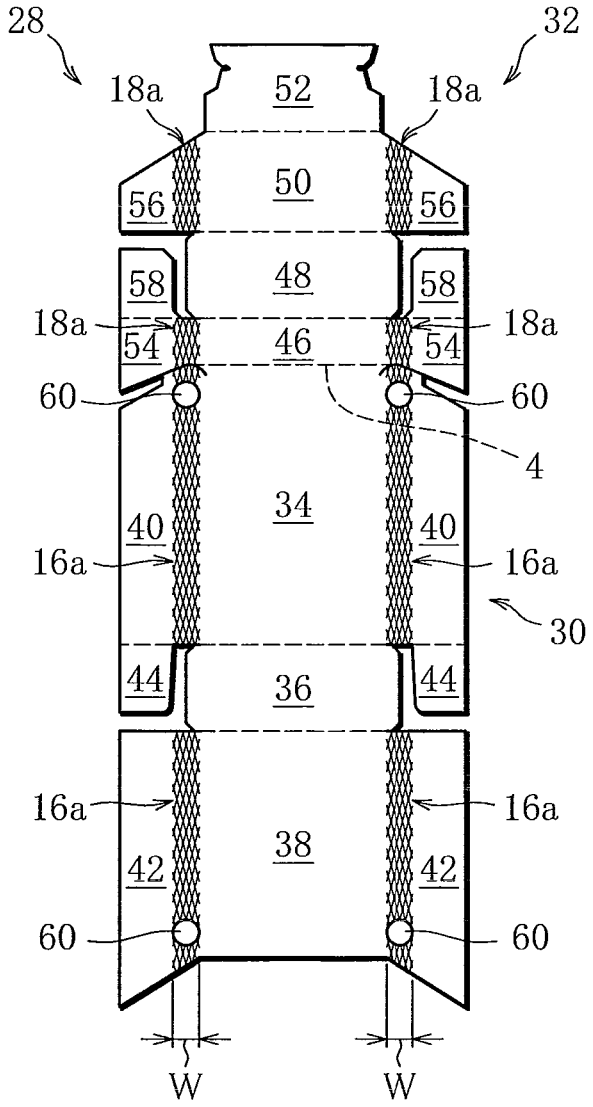
FIG. 4 is a view showing an inner surface of a blank for forming the box body and a lid shown in FIGS. 1 and 2.
Figure 5:
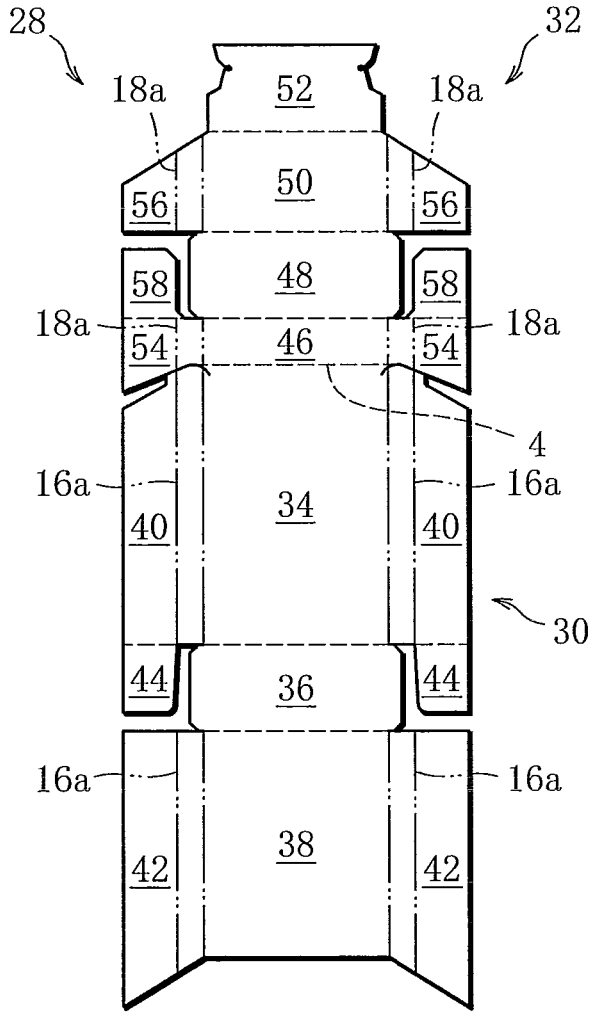
FIG. 5 is a view showing an outer surface of the blank shown in FIG. 4.

Features of the package of the invention will be clarified in the following descriptions about a blank 28 for forming the box body 8 and the lid 6. FIGS. 4 and 5 show inner and outer surfaces, respectively, of the blank 28.

As a basic form and folding process of the blank 28 are publicly known, the basic form of the blank 28 will be briefly described below.

The blank 28 is roughly divided into a main section 30 for forming the box body 8 and a subsection 32 for forming the lid 6. The main section 30 extends in one direction. The subsection 32 is connected to an upper end of the main section 30 through the self hinge 4 as shown in FIG. 4.

The main section 30 includes a rear panel 34, a bottom panel 36, and a front panel 38, in the order named from the subsection 32-side, or the self hinge 4-side. These panels 34, 36 and 38 are disposed in the longitudinal direction of the main section 30. Each two adjacent panels are connected to each other through a horizontal fold line extending across the main section 30. The panels 34, 36 and 38 form rear, bottom and front walls, respectively, of the box body 8.

Inner side flaps 40 are connected to both sides of the rear panel 34 through longitudinal fold lines extending in the longitudinal direction of the main section 30. The inner side flaps 40 form inner parts of side walls of the box body 8. Outer side flaps 42 are connected to both sides of the front panel 38 through longitudinal fold lines. The outer side flaps 42 form outer parts of the side walls. In short, the side walls of the box body 8 are formed by superposing the inner side flaps 40 upon the respective outer side flaps 42.

With reference to FIG. 4, inner bottom flaps 44 are connected to lower ends of the inner side flaps 40 through horizontal fold lines. The inner bottom flaps 44 are reinforcing members for the bottom panel 36, and form inner parts of the bottom wall of the box body 8.

The subsection 32 includes a rear panel 46, a top panel 48, a front panel 50 and an inner front panel 52. The panels 46, 48, 50 and 52 are disposed in the order named from the rear panel 34-side. Each two adjacent panels are connected to each other through a horizontal fold line. The panels 46, 48 and 50 form rear, top and front walls, respectively, of the lid 6. The inner front panel 52 is a reinforcing member for the front panel 50, and forms an inner part of the front wall of the lid 6.

As is apparent from FIG. 4, the bottom panel 36 and the top panel 48 for forming the bottom wall of the box body 8 and the top wall of the lid 6, respectively, have four arc-shaped corners corresponding to the rounded edges 16 and 18.

Inner side flaps 54 are connected to both sides of the rear panel 46 through longitudinal fold lines. Outer side flaps 56 are connected to both sides of the front panel 50 through longitudinal fold lines. Each of the inner flaps 54 and the corresponding outer side flap 56, which are disposed on either same side of the subsection 32, are superposed upon each other to form one of side walls of the lid 6.

Inner top flaps 58 are connected to upper edges of the inner side flaps 54 through horizontal fold lines. The inner top flaps 58 are reinforcing members for the top panel 48, and form inner parts of the top wall of the lid 6.

In general, each of the horizontal fold lines is a linear indentation that is created in the blank 28. However, the longitudinal fold lines for forming the rounded edges 16 and 18 are not indentations. The longitudinal fold lines have a shape of a strip extending in the longitudinal direction of the blank 28, and are formed into a groove pattern with a given width W.

Figure 6:
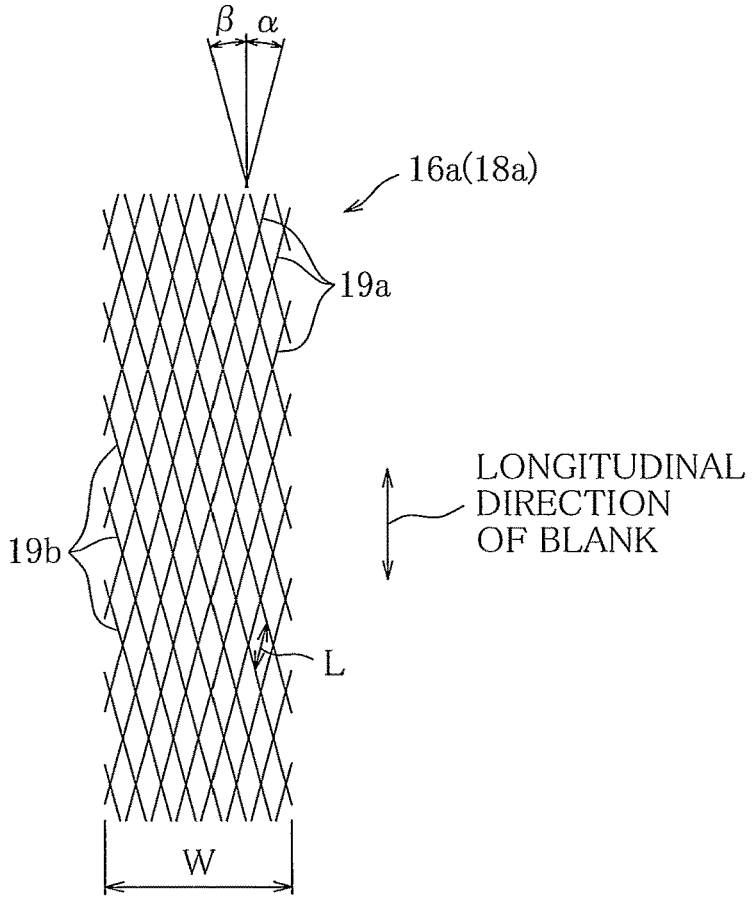
FIG. 6 is a plan view showing, in an enlarged scale, a part of a groove pattern shown in FIG. 4.

More specifically, groove patterns 16*a* and 18*a* for forming the rounded edges 16 and 18 are formed only in an inner surface of the blank 28 as shown in FIG. 6 in an enlarged scale. The groove patterns 16*a* and 18*a* include a large number of linear grooves 19 arranged in a lattice-like pattern. In other words, the linear grooves 19 can be divided into linear grooves 19*a* of a first group, which are inclined in relation to one direction of the blank 28, namely, the longitudinal direction of the box body 8, and linear grooves 19*b* of a second group, which are inclined in the opposite direction to the linear grooves 19 of the first group.

To be precise, it is preferable that inclination angles $\alpha$ and $\beta$ fall in a range from 5 to 45 degrees, where $\alpha$ and $\beta$ are the inclination angles of the linear grooves 19*a* and 19*b* in relation to the longitudinal direction of the box body 8. The inclination angles $\alpha$ and $\beta$ may be either identical to or different from each other.

The groove patterns 16*a* and 18*a* each have a width W of about 8 mm. The groove patterns 16*a* and 18*a* have lattice meshes that are defined by sides each having a length L of about 1.5 mm.

Figure 7:
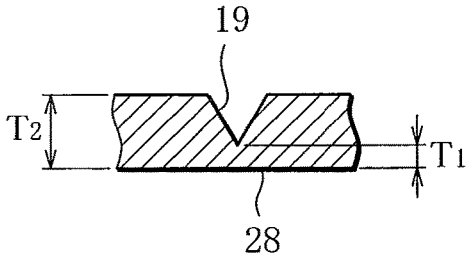
FIG. 7 is a cross-sectional view of the groove pattern shown in FIG. 6.

In the present embodiment, the linear grooves 19 are obtained by forming V-shaped cuts in the inner surface of the blank 28. As shown in FIG. 7, the linear grooves 19 each have such depth that there remains given thickness T1 between a bottom of each of the linear grooves 19 and the outer surface of the blank 28. The thickness T1 is determined less than 50 percent of T2, where T2 is thickness of the blank 28, and yet at such a value that the blank 28 is not broken from the linear grooves 19 in the process of folding the blank 28. The thickness T2 of the blank 28 is within a range from 0.3 to 0.35 mm.

The groove patterns 16*a* and 18*a* practically decrease the thickness of the blank 28. As a result, the regions of the blank 28, in which the groove patterns 16*a* and 18*a* are located, are more flexible than other regions of the blank 28. For this reason, when the rounded edges 16 and 18 are created by folding the blank 28 along the groove patterns 16*a* and 18*a*, the linear grooves 19 of the groove patterns 16*a* and 18*a* absorb difference between an arc length of outer surfaces of the round edges and an arc length of inner surfaces thereof, thereby forming smooth outer surfaces in the rounded edges 16 and 18.

Consequently, the blank 28, or the flaps 40 and 42 of the blank 28, are stably folded along the groove patterns 16*a* and 18*a*. It is then possible to surely form the rounded edges 16 and 18 each in a desired arc-like shape.

Since the groove patterns 16*a* and 18*a* are flexible, it is not necessary to preliminarily fold the groove patterns 16*a* and 18*a*. This enables the folding work of the blank 28 to be carried out using a conventional packing machine, and the package shown in FIGS. 1 and 2 can be formed without difficulty.

As is evident from FIG. 5, the groove patterns 16*a* and 18*a* are not exposed in the outer surface of the blank 28. Accordingly, the outer surfaces of the round edges 16 and 18 of the package are smooth when the package is fabricated with the blank 28, which provides a package with an excellent appearance.

In the groove patterns 16*a* and 18*a*, there remains the thickness T1 between the bottom of each of the linear grooves 19 and the outer surface of the blank 28. When the inner and outer side flaps 40 and 42 are folded along the groove patterns 16*a*, a design corresponding to the groove patterns 16*a*, namely, a lattice design F, appears like a relief in the outer surface of the rounded edge 16 as shown in a part of the rounded edge 16 illustrated in FIG. 1 in an enlarged scale. When the flaps 56 are folded along the groove patterns 18*a*, a similar lattice design F appears in the outer surface of the rounded edge 18. Such a lattice design F makes unique the appearance of the package of the present embodiment, and greatly contributes to further improvement of the appearance.

Preferably, the groove patterns 16*a* of the blank 28 have a plurality of reinforcing patches 60 as shown in FIG. 4, prior to the folding work of the blank 28. Each of the reinforcing patches 60 is disposed at an end region of the corresponding groove pattern 16*a*, which is on the open-end side of the box body 8, so as to stretch across the groove pattern 16*a*.

Figure 8:
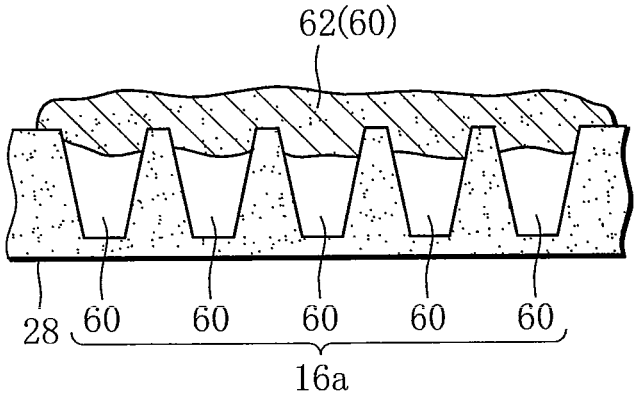
FIG. 8 is a cross-sectional view showing a part of the blank shown in FIG. 4.
Figure 9:
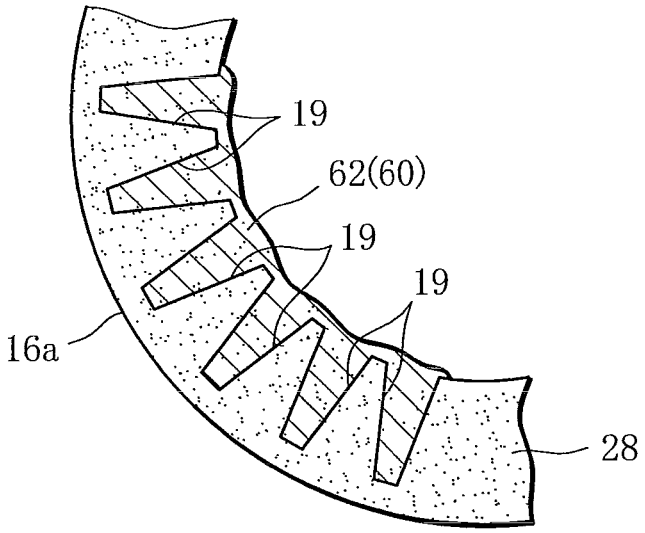
FIG. 9 is a cross-sectional view showing a part of a rounded edge.

In particular, as is apparent from FIG. 8, the reinforcing patches 60 are made of glue 62 applied to the groove patterns 16*a*. The glue 62 that has just been applied possesses liquidity, so that the glue 62 does not become any resistance against the folding of the blank 28 along the groove patterns 16*a*. When the blank 28 is folded, the glue 62 gets into the linear grooves 19 of the groove patterns 16*a* as shown in FIG. 9. Subsequently, after the reinforcing patches 60 produced by the glue 62 is hardened, the reinforcing patches 60 help improve the strength of the groove patterns 16*a*, or the rounded edges 16. The open end of the box body 8 then becomes hard to deform, and the lid 6 can be smoothly and surely opened and closed.

The linear grooves 19 shown in FIGS. 8 and 9 are different from the linear grooves 19 shown in FIG. 7 in sectional shape. This means that the linear grooves 19 are not limited in sectional shape.

The glue 62 forming the reinforcing patches 60 may be used to bond the box body 8 to the inner frame 10. It is therefore possible to eliminate the process of applying an adhesive agent for bonding the box body 8 and the inner frame 10 to each other.

The invention is not limited to the one embodiment described above, but may be modified in various ways.

Figure 10:
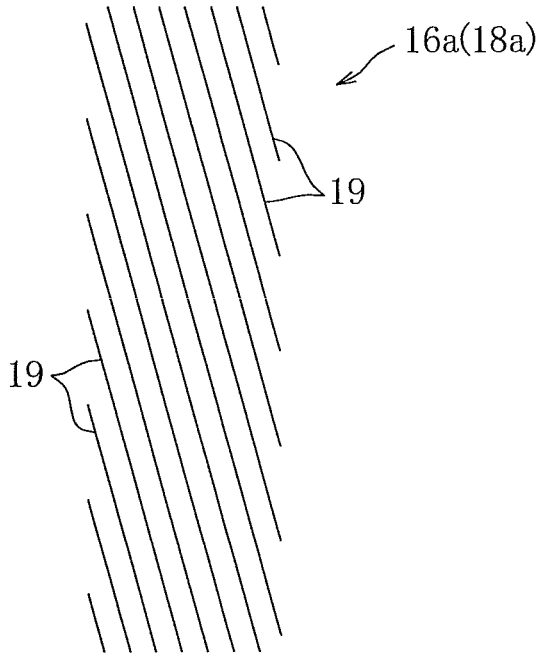
FIG. 10 is a view showing a groove pattern of a modification example.

For example, the groove patterns 16*a* and 18*a* for forming the rounded edges 16 and 18 are not limited to the lattice-like pattern, and may have other various figures. For example, as shown in FIG. 10, the groove patterns 16*a* and 18*a* may be a slash design. This slash design is formed of the group of either the linear grooves 19*a* or 19*b*.

Figure 11:
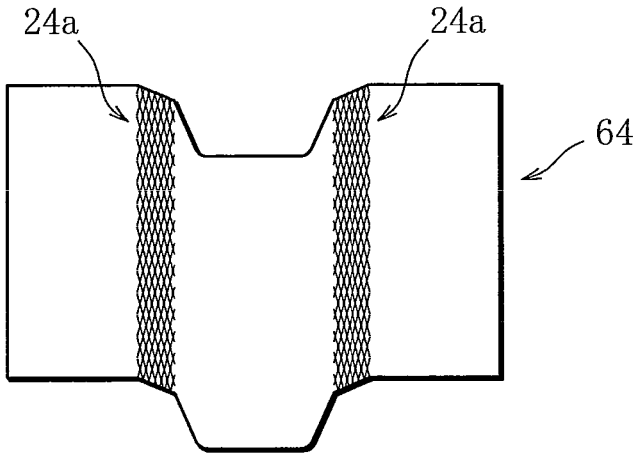
FIG. 11 is a view showing a blank for an inner frame of the modification example.

FIG. 11 shows a paper blank 64 for forming an inner frame 10 of the modification example.

There are two groove patterns 24*a* for forming rounded edges, instead of the angular edges 24, in an inner surface of the blank 64. The groove patterns 24*a* are also formed of a lattice-like pattern similar to the groove patterns 16*a* and 18*a* or a group of linear grooves.

Front and rear horizontal edges of the bottom wall of the box body 8 and those of the top wall of the lid 6 may be formed into rounded edges similar to the round edges 16 and 18.

The package of the invention needs to have at least either one of the rounded edges 16 or 18. The invention can be applied not only to the hinge-lid package but also to a tongue-lid package as well.

The invention claimed is:

1. A package of rod-shaped smoking articles comprising:

a box body formed of paper material, the box body having an open end, said box body including a rounded edge forming at least one longitudinal edge extending along a longitudinal direction of said box body, the rounded edge having an arc-like shape as viewed in cross-section of said box body and a smooth outer surface;

a lid connected to the open end of said box body through a hinge, for opening and closing the open end; and a plurality of cuts provided only on an inner surface of the rounded edge to keep an outer surface of the rounded edge smooth, the plurality of cuts creating a design appearing only on the smooth outer surface of the rounded edge, the design being caused by a groove pattern formed by the plurality of cuts; and a reinforcing patch disposed on the groove pattern on the inner surface;

wherein the reinforcing patches are formed by glue applied to the inner surfaces and stretching across the groove patterns in the vicinity of the open end.

2. The package of rod-shaped smoking articles according to claim 1, wherein the rounded edge is formed in each of four longitudinal edges of said box body.

3. A blank, comprising:

a main section extending in one direction, for forming a box body, and a subsection connected to one end of said main section through a hinge to form a lid; said main section formed of paper material and including:

a rear panel, a bottom panel, and a front panel aligned in the one direction, for forming a rear wall, a bottom wall, and a front wall, respectively, of said box body, the rear, bottom and front panels, among which each two adjacent panels being connected to each other through a horizontal fold line; and inner and outer side flaps connected to both sides of the rear panel and of the front panel through longitudinal fold lines, for forming inner and outer parts of side walls of said box body, wherein at least one longitudinal fold line is formed by a plurality of cuts on an inner surface for forming a rounded edge of said box body, the rounded edge having an arc-like shape as viewed in cross-section of said box body and a smooth outer surface; and the plurality of cuts creating a design appearing only on the smooth outer surface of the rounded edge, the design being caused by a groove pattern formed by the plurality of cuts;

a reinforcing patch disposed on the groove pattern on the inner surface; and wherein the reinforcing patches are formed by glue applied to the inner surfaces and stretching across the groove patterns in the vicinity of the open end.

4. The package of claim 1, wherein the groove pattern is formed by a plurality of cuts, the cuts reducing a thickness of the rounded edge while keeping the outer surface smooth so as to provide the arc-like shape and the design on the rounded edge.

5. The package of claim 4, wherein the reduced thickness of the rounded edge is less than 50 percent of the thickness between an inner surface and an outer surface of the rounded edge.

6. The package of claim 4, wherein the cuts includes a first plurality of cuts and a second plurality of cuts at an angle to the first plurality of cuts to form the design into a plurality of columns and rows of diamond shapes.

7. The package of claim 6, wherein a width of each diamond shape is less than the width of the rounded edge.

8. The package of claim 6, the first plurality of cuts and the second plurality of cuts extend an entire length of the at least one of the longitudinal fold lines.

9. The package of claim 6, wherein each of the first plurality of cuts extends across at least two of the second plurality of cuts.

10. The blank of claim 3, wherein the groove pattern is formed by a plurality of cuts, the cuts reducing a thickness of the at least of one of the longitudinal fold lines while keeping the outer surface of the at least one of the longitudinal lines smooth so as to provide the arc-like shape and the design of the rounded edge.

11. The blank of claim 10, wherein the reduced thickness of the at least one of the longitudinal fold lines is less than 50 percent of the thickness between inner and outer surface of the at least one of the longitudinal fold lines.

12. The blank of claim 10, wherein the cuts includes a first plurality of cuts and a second plurality of cuts at angle to the first plurality of cuts to form the design into a plurality of columns and rows of diamond shapes.

13. The blank of claim 12, wherein each of the first plurality of cuts extends across at least two of the second plurality of cuts.

14. The blank of claim 10, wherein the cuts include a plurality of parallel cuts at angle to the one direction, the parallel cuts not being connected to one another to form the design into a slash design, and wherein the plurality of the parallel cuts extend an entire length of the at least one of the longitudinal fold lines.

15. The blank of claim 11, wherein the first plurality of cuts and the second plurality of cuts extend an entire length of the at least one of the longitudinal fold lines.

16. The blank of claim 11, wherein a width of each diamond shape is less than the width of the at least one of the longitudinal fold lines.

* * * * *